US008337075B2

(12) United States Patent
Haenzi et al.

(10) Patent No.: US 8,337,075 B2
(45) Date of Patent: Dec. 25, 2012

(54) SINGLE PUSH-PIECE CHRONOGRAPH

(75) Inventors: Werner Haenzi, Safnern (CH); Jean-Luc Helfer, Bienne (CH); Antonio Merino, Moutier (CH); Patrick Moller, Flumenthal (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 170 days.

(21) Appl. No.: 12/976,052

(22) Filed: Dec. 22, 2010

(65) Prior Publication Data

US 2011/0149695 A1 Jun. 23, 2011

(30) Foreign Application Priority Data

Dec. 22, 2009 (EP) ..... 09180455

(51) Int. Cl.
*G04F 7/06* (2006.01)

(52) U.S. Cl. ..... 368/106; 368/101

(58) Field of Classification Search ..... 368/101–106
See application file for complete search history.

(56) References Cited

U.S. PATENT DOCUMENTS

| | | | | |
|---|---|---|---|---|
| 3,890,779 | A * | 6/1975 | Capt et al. | 368/103 |
| 4,364,669 | A * | 12/1982 | Thoenig et al. | 368/111 |
| 7,959,350 | B2 * | 6/2011 | Oppliger et al. | 368/106 |
| 2010/0322038 | A1 * | 12/2010 | Habring et al. | 368/106 |

FOREIGN PATENT DOCUMENTS

| | | | |
|---|---|---|---|
| CH | 740 | A | 6/1889 |
| CH | 283 491 | A | 6/1952 |
| CH | 309 240 | A | 8/1955 |
| FR | 1 519 610 | A | 4/1968 |
| WO | 2008/075147 | A2 | 6/2008 |
| WO | 2009/098307 | A1 | 8/2009 |

OTHER PUBLICATIONS

Hanhart Primus, "Die Alternative," Chronos, Ebner Verlag, DE, vol. 6, Jan. 1, 2002, pp. 110-114, XP003025906.
European Search Report issued in corresponding application No. EP 09 18 0455, completed Apr. 26, 2010.

* cited by examiner

*Primary Examiner* — Sean Kayes
(74) *Attorney, Agent, or Firm* — Griffin & Szipl, P.C.

(57) ABSTRACT

A chronograph includes a chronograph train, means for coupling the train and a device for controlling the coupling means, which includes:

a pivotably mounted shuttle, a first angular sector provided with two notches defining first and second stable angular positions, and a second angular sector that includes cut out portions, an elastic member cooperating with the notches to keep the shuttle in one of the stable positions, and a push-piece cooperating with the cut out portions to pivot the shuttle, via a first application of pressure, from the first stable position to the second stable position, and via a second application of pressure, from the second stable position to a third intermediate angular position.

8 Claims, 9 Drawing Sheets

SINGLE PUSH-PIECE CHRONOGRAPH

This application claims priority from European Patent Application No. 09180455.9 filed Dec. 22, 2009, the entire disclosure of which is incorporated herein by reference.

FIELD OF THE INVENTION

The present invention relates to the field of watchmaking. It concerns more specifically a single push-piece chronograph comprising a shuttle performing the "start", "stop" and "reset" functions using the same push-piece.

BACKGROUND OF THE INVENTION

Chronographs of this type are already known to those skilled in the art. One such chronograph is disclosed in WO Patent No. 2008/075147. This is a chronograph that includes a chronograph train, coupling means, reset means and a control device for the coupling means and reset means. The control device includes a pivotably mounted shuttle, a first angular sector of which is provided with three notches defining three stable angular positions, respectively corresponding to the "reset", "start", "stop" functions, and an elastic member cooperating with the notches to hold the shuttle in one of the positions. The control device further includes a push-piece provided with a hinged finger with two beaks, cooperating with a series of cut out or blanked portions formed in a second angular sector of the shuttle, so as to cause the shuttle to change, via successive applications of pressure, from the reset position to the start position, from the start position to the stop position, then from the stop position to the reset position, and so on. The complex shape of the cut out portions and the two beaks is designed so that, depending upon the initial angular position of the shuttle, a first beak causes pivoting in one direction or the other, while the second beak locks the pivoting movement at the end of travel. The two beaks alternately perform the push and lock functions when the user presses repeatedly on the push-piece. The entire, three phase operating cycle of the single push-piece chronograph thus described is completed in three applications of pressure.

SUMMARY OF THE INVENTION

The present invention offers an alternative to the operating mode of the chronograph embodiment thus disclosed, by proposing a single push-piece chronograph that completes one operating cycle in two applications of pressure. More specifically, the invention concerns a chronograph including a chronograph train, means for coupling the train and a device controlling the coupling means, which includes a pivotably mounted shuttle, a first angular sector of which is provided with two notches defining first and second stable angular positions, and a second angular sector of which includes cut out portions. The control device for the coupling means further includes an elastic member cooperating with the notches to hold the shuttle in one of the two stable positions, and a push-piece cooperating with the cut out portions to pivot the shuttle, as a result of a first application of pressure, from the first stable position to the second stable position, and as a result of a second application of pressure, from the second stable position to a third intermediate angular position. According to the invention, the third intermediate angular position is unstable and defined on the first angular sector of the shuttle by an inclined surface located between the notches, the inclined surface being arranged such that the action of the elastic member pivots the shuttle from the third position to the first stable position when the push-piece is released, and the coupling means control device further includes means for locking the shuttle in a third unstable position when the push-piece is pushed in.

Owing to the inclined surface located between the notches defining the two stable shuttle positions, the third position is reached when the push-piece is pressed a second time, and the first position is reached when the push-piece is released after the second application of pressure. The operating cycle of the chronograph is thus a conventional three-phase cycle, but only two applications of pressure are required to complete the cycle.

BRIEF DESCRIPTION OF THE DRAWINGS

Other features and advantages of the present invention will appear more clearly from the following detailed description of a example embodiment of the single push-piece chronograph according to the invention, this example being given purely by way of non-limiting illustration, with reference to the annexed drawing, in which:

FIGS. 7 to 9 are views of two embodiments of the means for locking a chronograph of this type in a third, unstable position, with the push-piece pushed in.

DETAILED DESCRIPTION OF THE INVENTION

Figure 1:
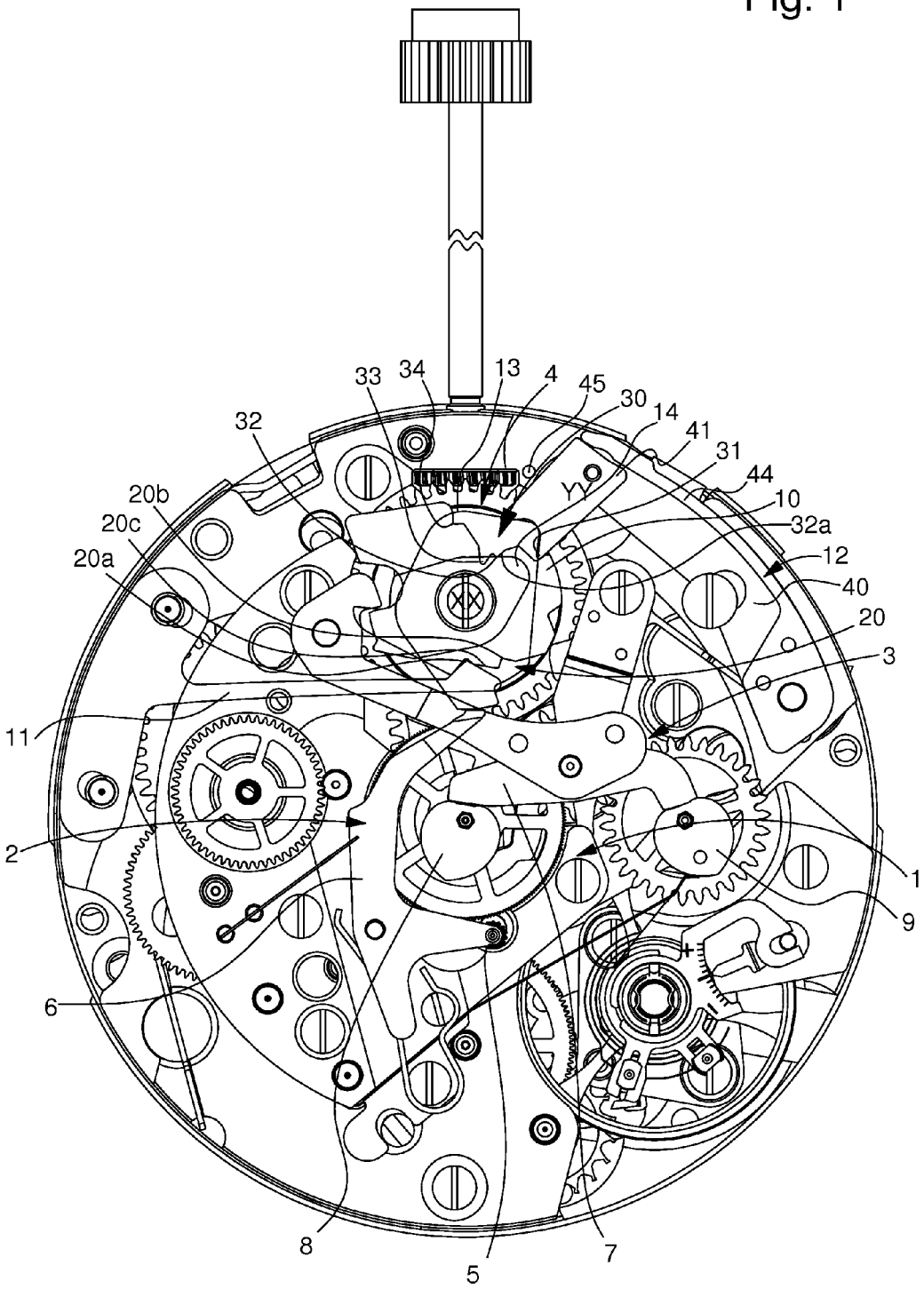
FIG. 1 shows a single push-piece chronograph according to the invention, in the first position, with the push-piece released.

The single push-piece chronograph shown in FIG. 1 in the reset position, includes, in a conventional manner, a chronograph train 1, carrying a chronograph seconds hand and a chronograph minutes hand (not shown), and means 2 for coupling chronograph train 1, for placing the chronograph train 1 in kinematic connection with a going train. It further includes means 3 for resetting the seconds and minutes hands to zero, and a control device 4 for coupling means 2 and reset means 3.

Coupling means 2 are formed, in a known manner, from a coupling pinion 5, mounted on a coupling lever 6, which is mobile between a "start" position, in which pinion 5 is meshed with chronograph train 1 and the going train, and a "stop" position, in which pinion 5 is released from the chronograph train. Reset means 3 include, in a conventional manner, a hammer 7 acting on heart pieces 8 and 9, which are integral in rotation with the seconds and minute hands. These elements and the operation thereof are known to those skilled in the art, and will not be described in further detail here.

Control device 4 includes a shuttle 10, pivotably mounted about an axis XX, a jumper spring 11 cooperating with the shuttle 10 to position the shuttle angularly, and a push-piece 12 for pivoting shuttle 10. It further includes a coupling cam 13 and a reset cam 14, integral with shuttle 10 as the latter pivots, and respectively cooperating with coupling lever 6 and hammer 7 to activate, in a well known manner, the "start", "stop" and "reset" functions of the chronograph, depending upon the angular position of shuttle 10.

Shuttle 10 includes a first angular sector 20 comprising two notches 20*a* and 20*b*, respectively defining a first stable angular position A, corresponding to the "reset" function, and a second stable angular position B, corresponding to the "start" function. Jumper spring 11 cooperates with notches 20*a* and 20*b* to hold shuttle 10 in one or other of the stable angular positions A and B. According to the invention, the first angular sector 20 further includes an inclined surface 20*c*, located between notches 20*a* and 20*b* and defining a third unstable angular position C, corresponding to the "stop" function of the chronograph. "Inclined surface" means a surface that is not perpendicular to the radius of the point being considered. The inclination of surface 20*c* is determined such that jumper spring 11 pivots shuttle 10 towards angular position A when it abuts the surface 20*c*.

Shuttle 10 has a second angular sector 30 including cut out portions in complex shapes. In a first embodiment shown in FIGS. 1 to 6, angular sector 30 includes, anticlockwise, a first L-shaped blanked portion 31, then a small recess 32 with an approximately radial flank 32*a*. It then includes a notch 33, and finally a second L-shaped out cut portion 34. In a second embodiment, illustrated in FIG. 7, the small recess 32 is more accentuated to form a third cut out portion 35 with an L-shaped profile. We will examine the profile of this third cut out portion and the function thereof in more detail with reference to FIG. 7. In a fourth embodiment shown in FIG. 9, the small recess 32 is replaced by a notch 36, whose function will be explained with reference to FIG. 9.

Push-piece 12 is formed of a pivotably mounted arm 40, provided with a finger 41, mounted to rotate freely at the end thereof about an axis YY. Finger 41 ends in first and second beaks respectively 42, 43, which cooperate with L-shaped cut out portions 31, 34, 35, notches 33, 36 and recess 32 to pivot shuttle 10 or lock it in the three angular positions A, B and C. An elastic member 44, mounted on arm 40, abuts on the rear surface of finger 41 to position the finger approximately radially relative to axis XX of shuttle 10. Finally, a stop member 45 is mounted in proximity to finger 41 so as to limit the rotational amplitude thereof, as will be described below.

The operating cycle of the single push-piece chronograph hereby disclosed is shown in FIGS. 2 to 6. To make the Figures easier to read, coupling cam 13, reset cam 14, coupling means 2 and reset means 3 have deliberately been omitted. This improves comprehension of the invention.

Figure 2:
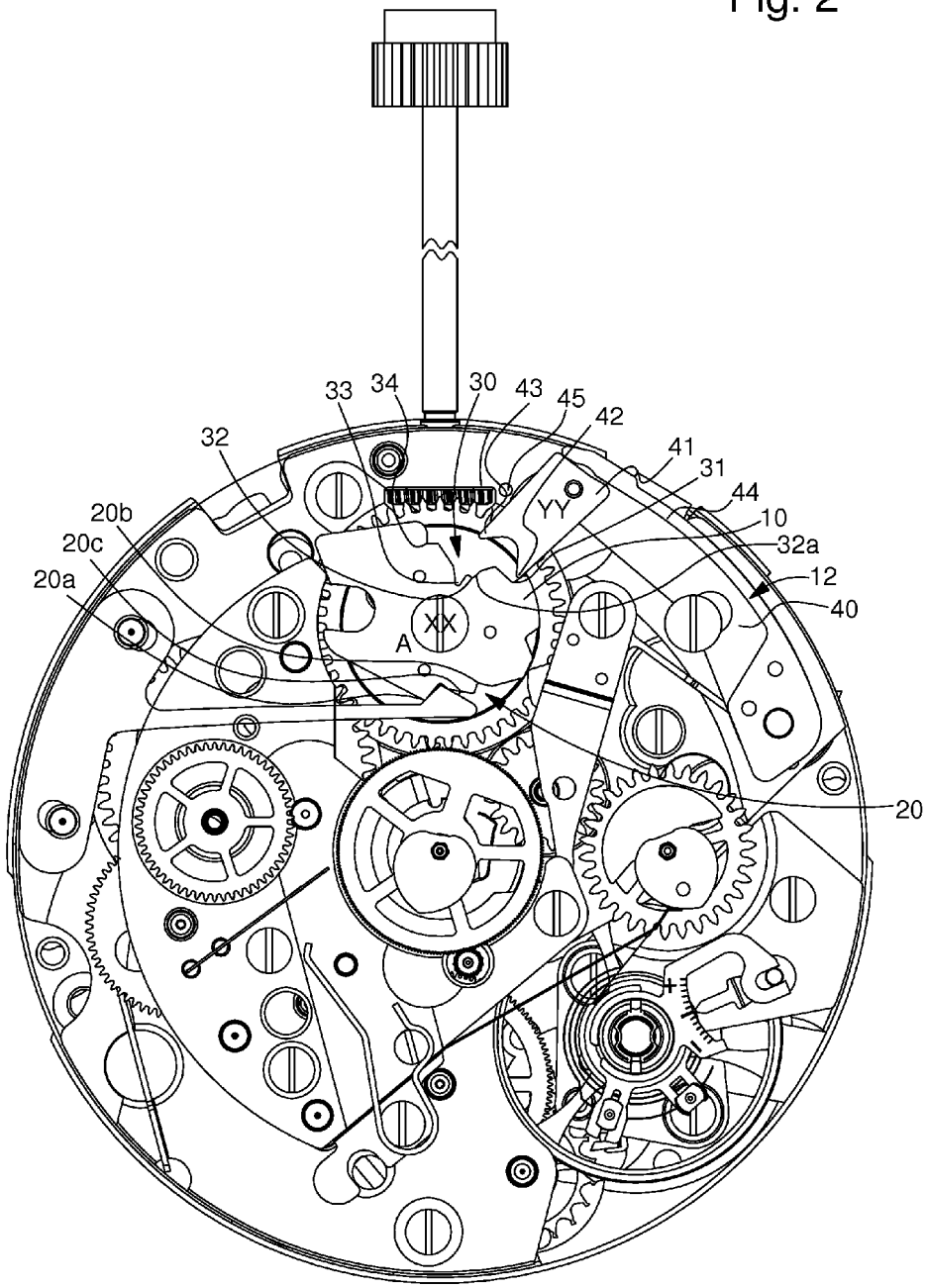
FIGS. 2 to 6 illustrate the operating cycle of a single push-piece chronograph according to the invention.

The single push-piece chronograph according to the invention is shown in the "reset" position in FIG. 2. In this position, chronograph train 1 is stopped, and the chronograph hands point to indication "0". Shuttle 10 is positioned in the first stable angular position A by jumper spring 11, which cooperates with notch 20*a* of angular sector 20. Push-piece 12 is released, first beak 42 being positioned in the first L-shaped cut out portion 31.

Figure 3:
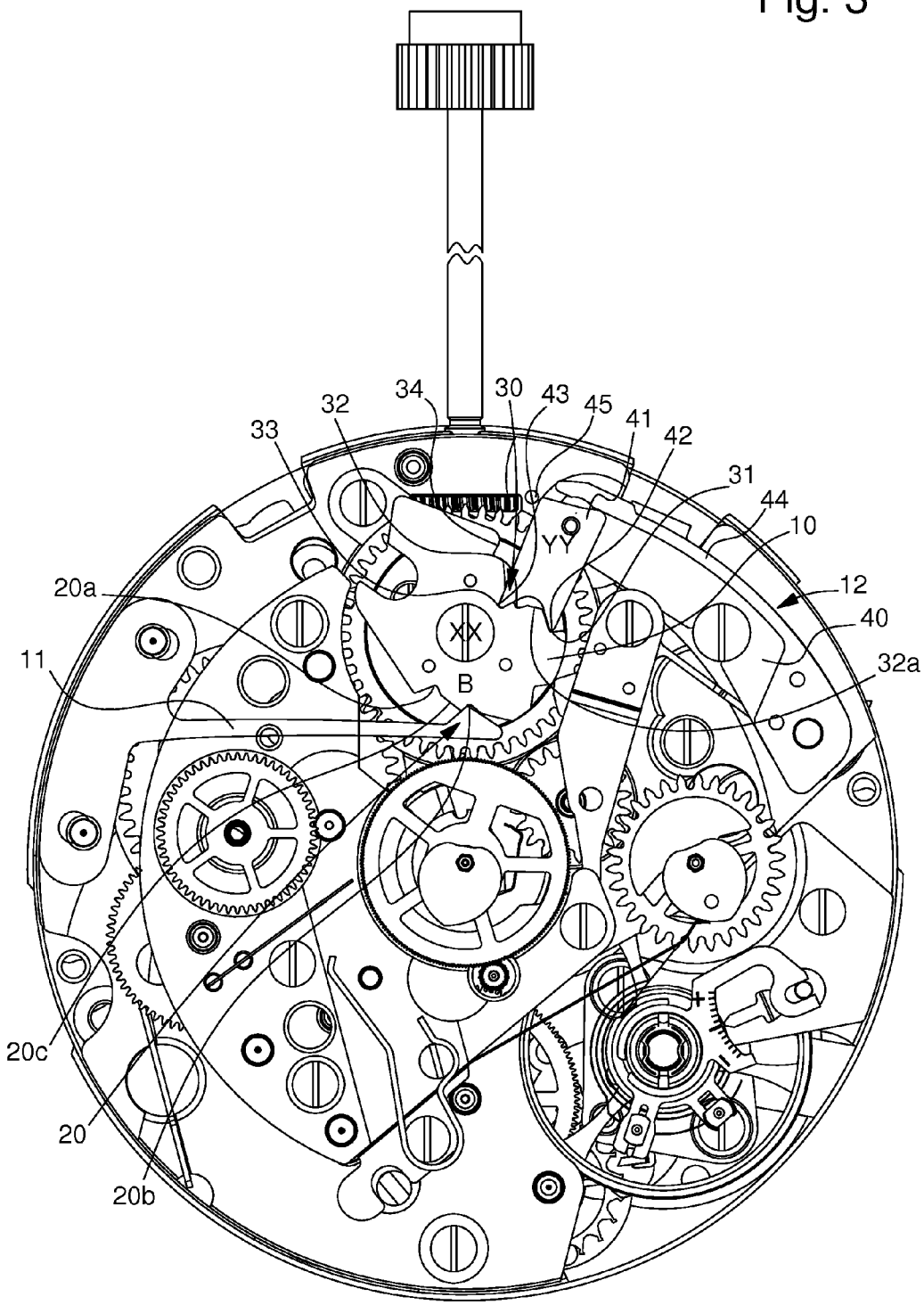
Figure 4:
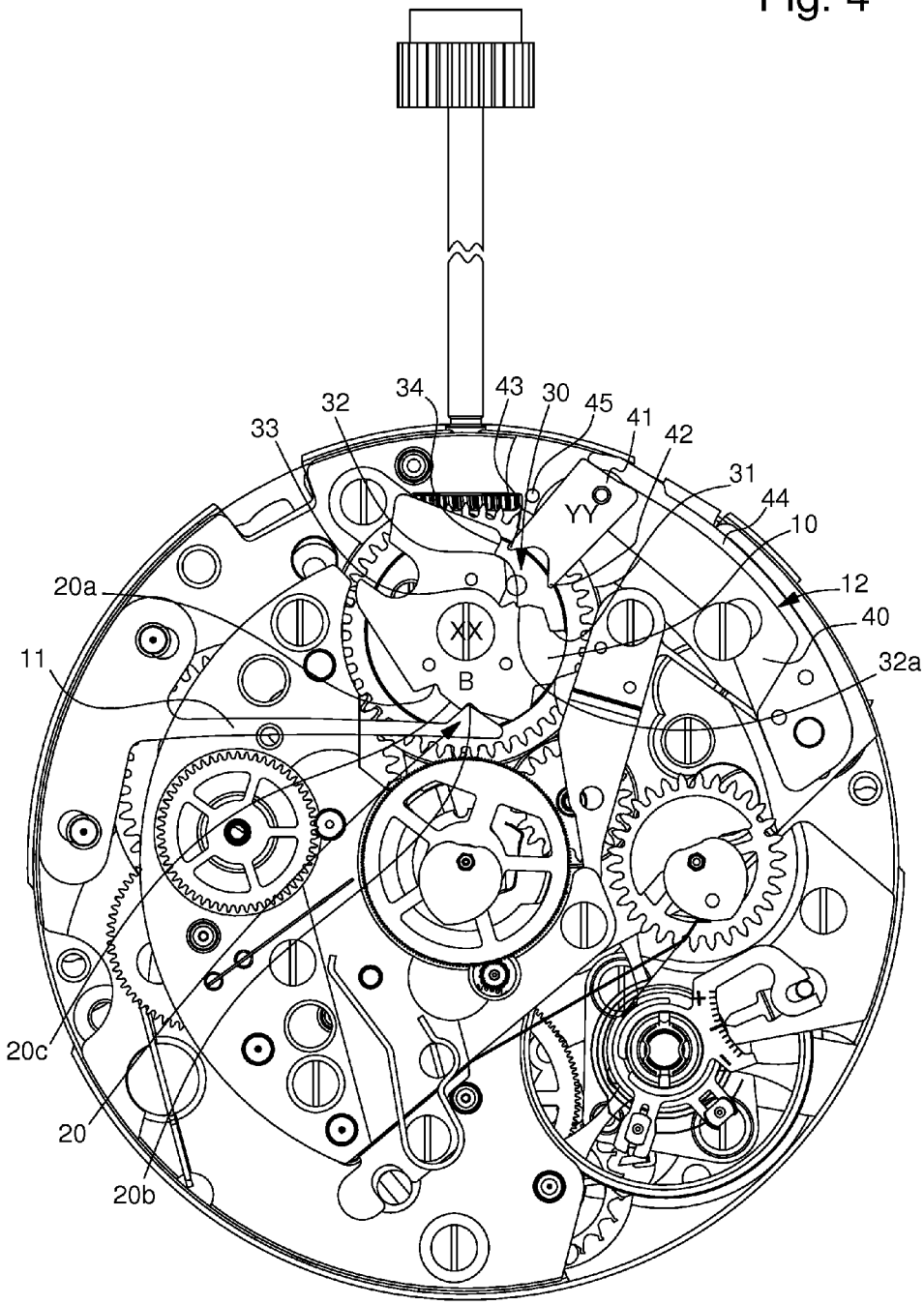
Figure 5:
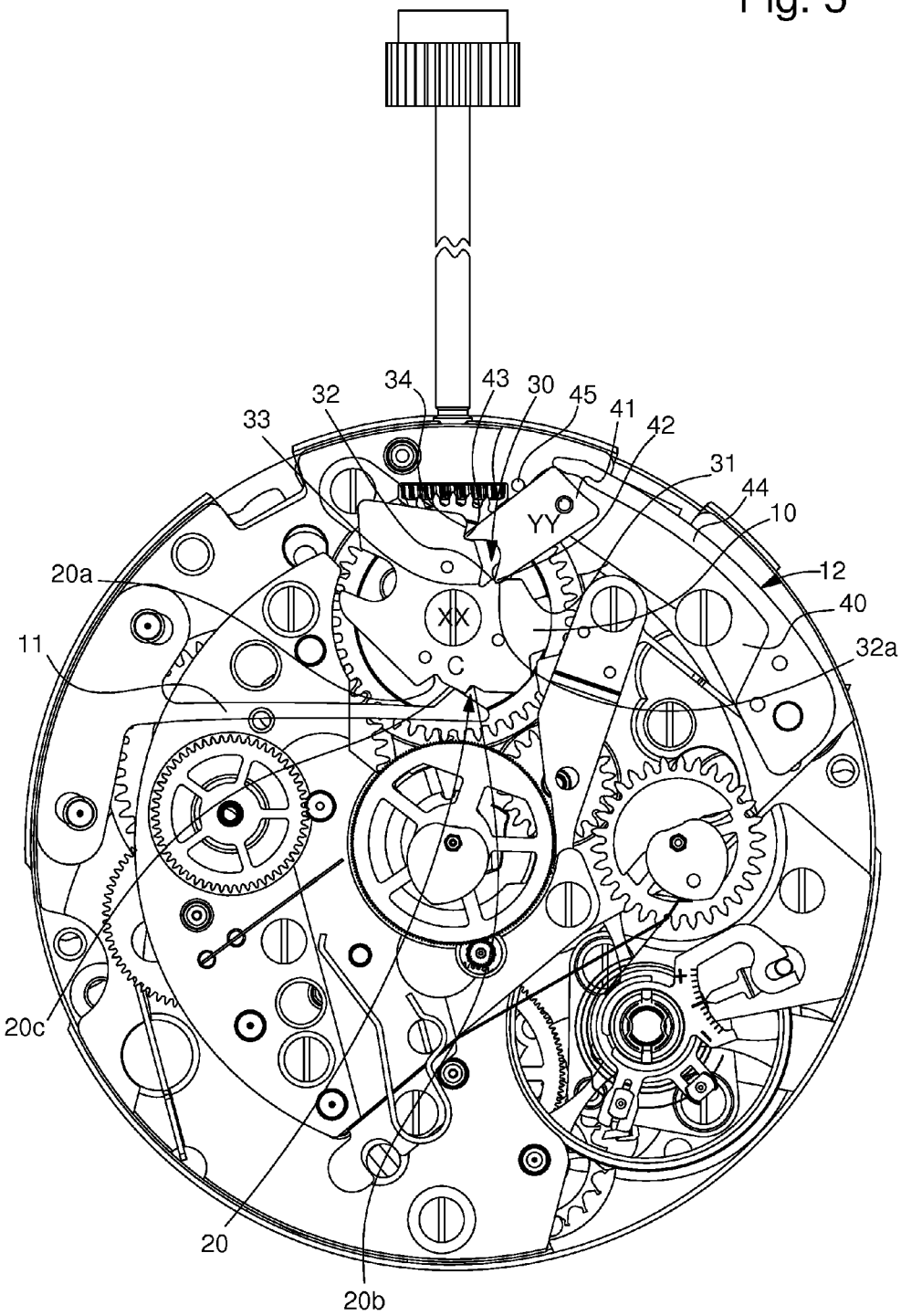

In FIG. 3, push-piece 12 is pushed in via the action of a first application of pressure by the user. Push-piece 12 pivots shuttle 10 clockwise, via first beak 42, which pushes in the corner of the first L-shaped cut out portion 31. The pivoting of shuttle 10, combined with that of push-piece 12 and finger 41, enables second beak 43 to engage in notch 33. Once it is totally inserted in the notch 33, second beak 43 locks the pivoting movement of shuttle 10, which is then in angular position B corresponding to the "start" function of the chronograph. In this position, coupling cam 13 acts on coupling lever 6 to start the chronograph.

Push-piece 12 is then released by the user and shuttle 10 is held in angular position B by jumper spring 11, which cooperates with notch 20*b* of angular sector 20. In this position, shown in FIG. 4, chronograph train 1 rotates, driving the chronograph hands in rotation. It will be noted that first beak 42 is no longer positioned in first L-shaped cut out portion 31, but that second beak 43 is now positioned in proximity to the second L-shaped cut out portion 34.

In FIG. 5, push-piece 12 is again pushed in via the action of a second application of pressure by the user. This time push-piece 12 causes shuttle 10 to pivot anticlockwise, via second beak 43, which pushes in the corner of the second L-shaped cut out portion 34. Shuttle 10 pivots until finger 41 comes into contact with stop member 45, the first beak 42 then being engaged in recess 32. The radial flank 32*a* of recess 32 then abuts on first beak 42 of finger 41, which is itself abutting stop member 45. The pivoting movement of the shuttle is thus stopped in angular position C, corresponding to the "stop" function of the chronograph. In this position, jumper spring 11 abuts surface 20*c* of angular sector 20, and this action has a tendency to pivot shuttle 10 beyond angular position C, as far as stable angular position A. However, as long as the user keeps push-piece 12 pressed in, the action of jumper spring 11 is countered by that of stop member 45, which opposes the pivoting of shuttle 10 beyond angular position C, via finger 41. In this position, coupling cam 13 acts on coupling lever 6 to stop the chronograph. Chronograph train 1 is stopped, as are the chronograph hands.

Figure 6:
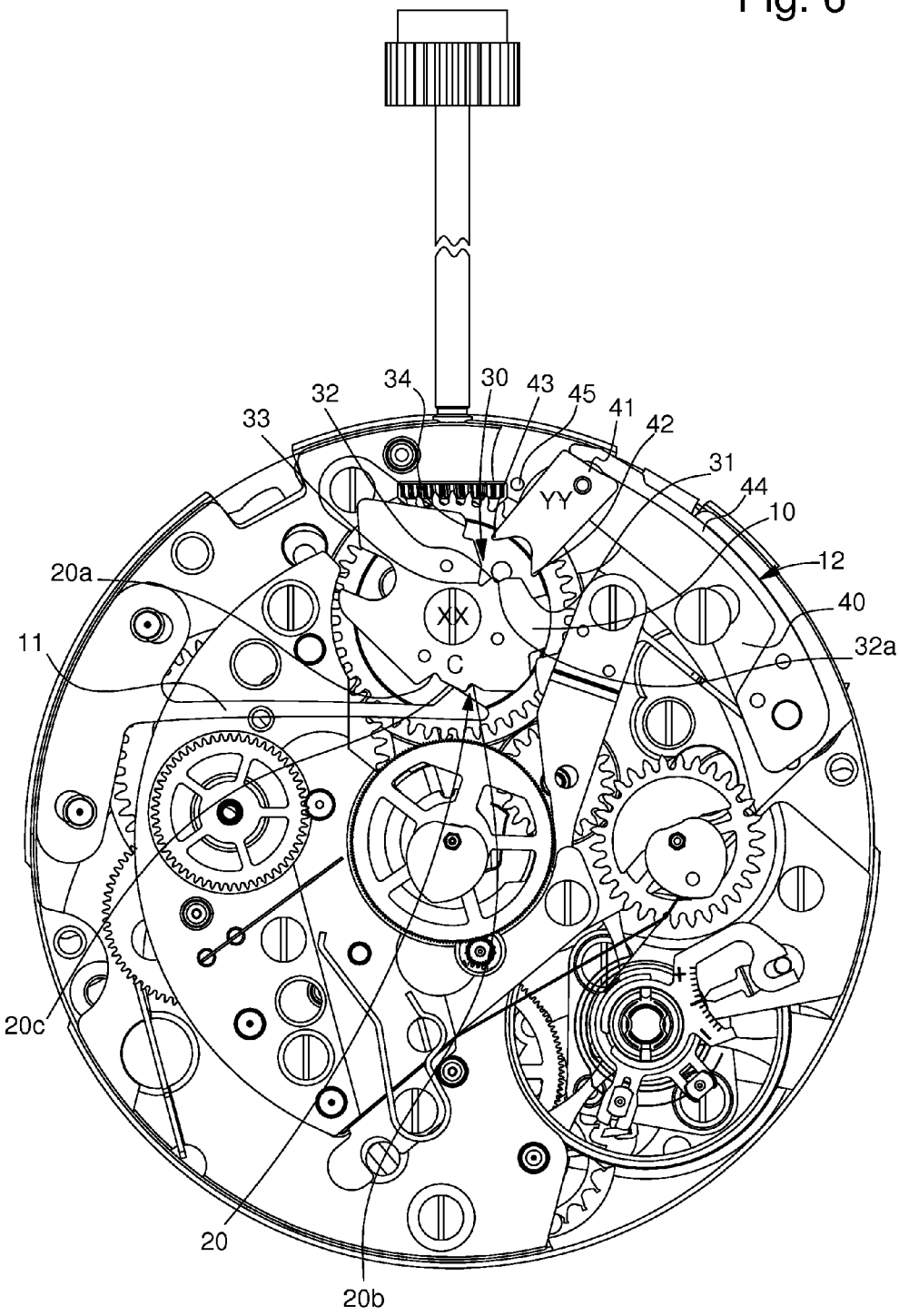

Push-piece 12 is then released a second time as shown in FIG. 6. In this position, jumper spring 11 abutting on surface 20*c* of angular sector 20, has a tendency to pivot shuttle 10 anticlockwise, and stop member 45 no longer opposes this movement, as finger 41 has been released. Angular position C is thus unstable, and the action of jumper spring 11 pivots shuttle 10 as far as stable angular position A, in which jumper spring 11 cooperates with notch 20*a*. In this position, reset cam 14 actuates hammer 7, which acts on heartpieces 8 and 9. The chronograph hands again point to indication "0". One chronograph operating cycle is completed. It will be noted that the chronograph operating cycle thus described is a conventional operating cycle of three phases, namely "stop", "start" and "reset", performed in two applications of pressure.

Figure 7:
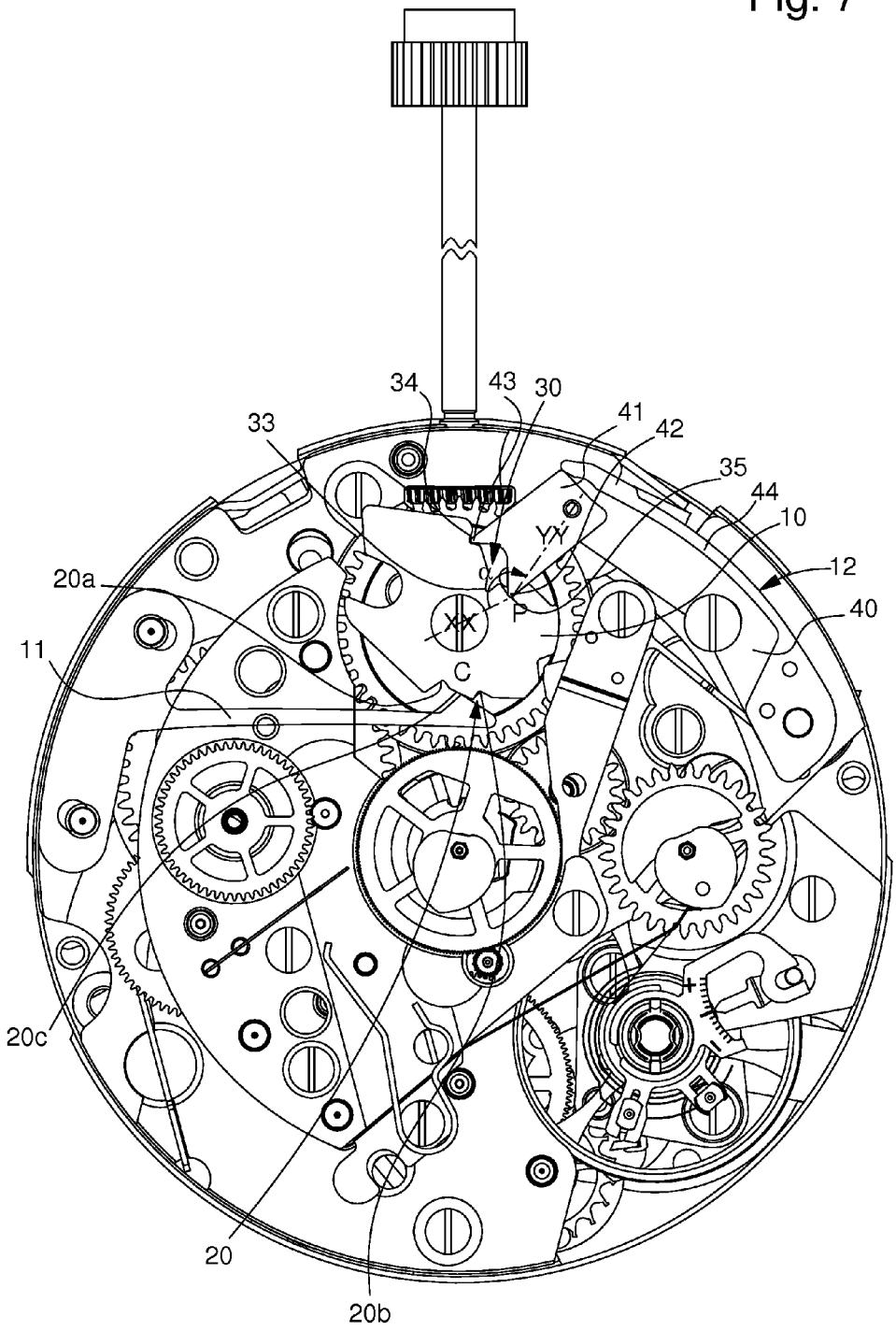

Reference will now be made to FIG. 7, which shows a second embodiment of the single push-piece chronograph according to the invention in the "stop" position. In this embodiment, the third cut out portion 35 replaces recess 32 and stop member 45 is absent. When the user presses push-piece 12 for the second time, second beak 43 pushes in the corner of the second L-shaped cut out portion 34, which causes shuttle 10 to pivot anticlockwise. This pivoting movement is stopped when first beak 42 engages in the third L-shaped cut out portion 35, and is lodged in the corner of the cut out portion. In this position, first beak 42 exerts moment on shuttle 10 in the clockwise direction, which opposes the moment exerted by jumper spring 11 in the anticlockwise direction. Shuttle 10 is then locked in unstable angular position C, and remains there for as long as the user keeps push-piece 12 pushed in. It will be noted that a geometrical condition must be satisfied for the respective moments of first beak 42 and jumper spring 11 to cancel each other out. If P is the point of contact between first beak 42 and the corner of the third cut out portion 35, the angle $\alpha$, formed between axis XX, point P and axis YY, must be less than 180 degrees. If this condition is satisfied, the respective moments of first beak 42 and jumper spring 11 are exerted in opposite directions. However, if angle $\alpha$ is greater than 180 degrees, both moments are exerted anticlockwise, and shuttle 10 is not locked in position C. The operation of this second embodiment of the single push-piece chronograph according to the invention is, otherwise, identical to that described with reference to FIGS. 2 to 6.

Figure 8:
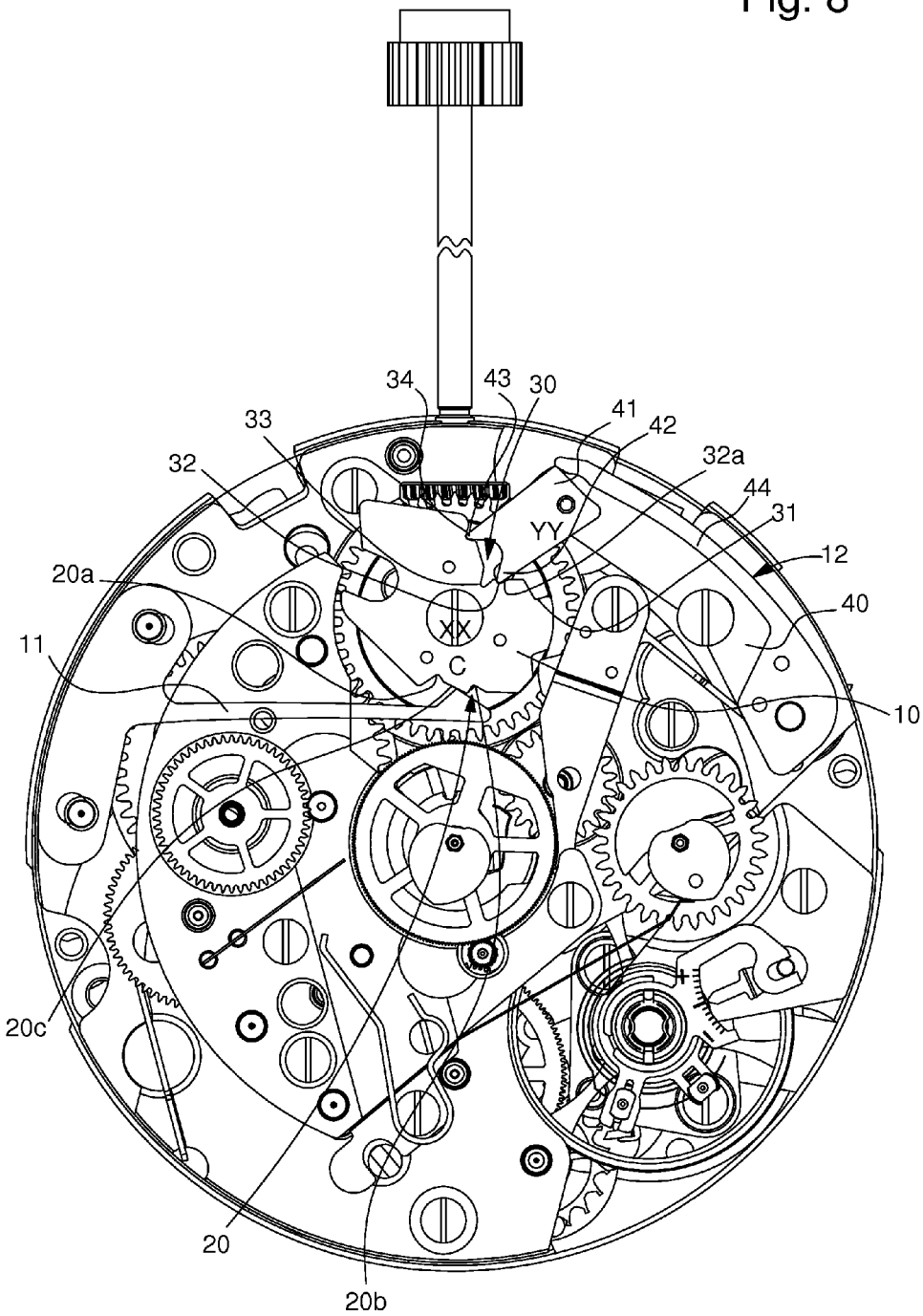

A third embodiment of the single push-piece chronograph according to the invention is illustrated in FIG. 8, in the "stop" position. In this embodiment, stop member 45 is absent, and elastic member 44 is sized so as to exert on finger 41, in angular position C, a greater moment than the moment exerted by jumper spring 11, via shuttle 10. When the user presses on push-piece 12, as before, the second beak 43 pivots shuttle 10 until first beak 42 engages in recess 32. Shuttle 32 is then in unstable angular position C, and jumper spring 11 has a tendency to pivot the shuttle beyond position C as far as angular position A. If the aforementioned condition is fulfilled, elastic member 44 opposes the rotational movement of finger 41, which itself opposes the rotational movement of shuttle 10. As long as the user keeps pressing on push-piece 12, shuttle 10 is thus locked in angular position C. The operation of this third embodiment of the single push-piece chronograph according to the invention is, otherwise, identical to that described with reference to FIGS. 2 to 6. It will be noted that elastic member 44 may also be pre-shaped, rather than sized, to exert a greater moment on finger 41 in angular position C than the moment exerted by jumper spring 11.

Figure 9:
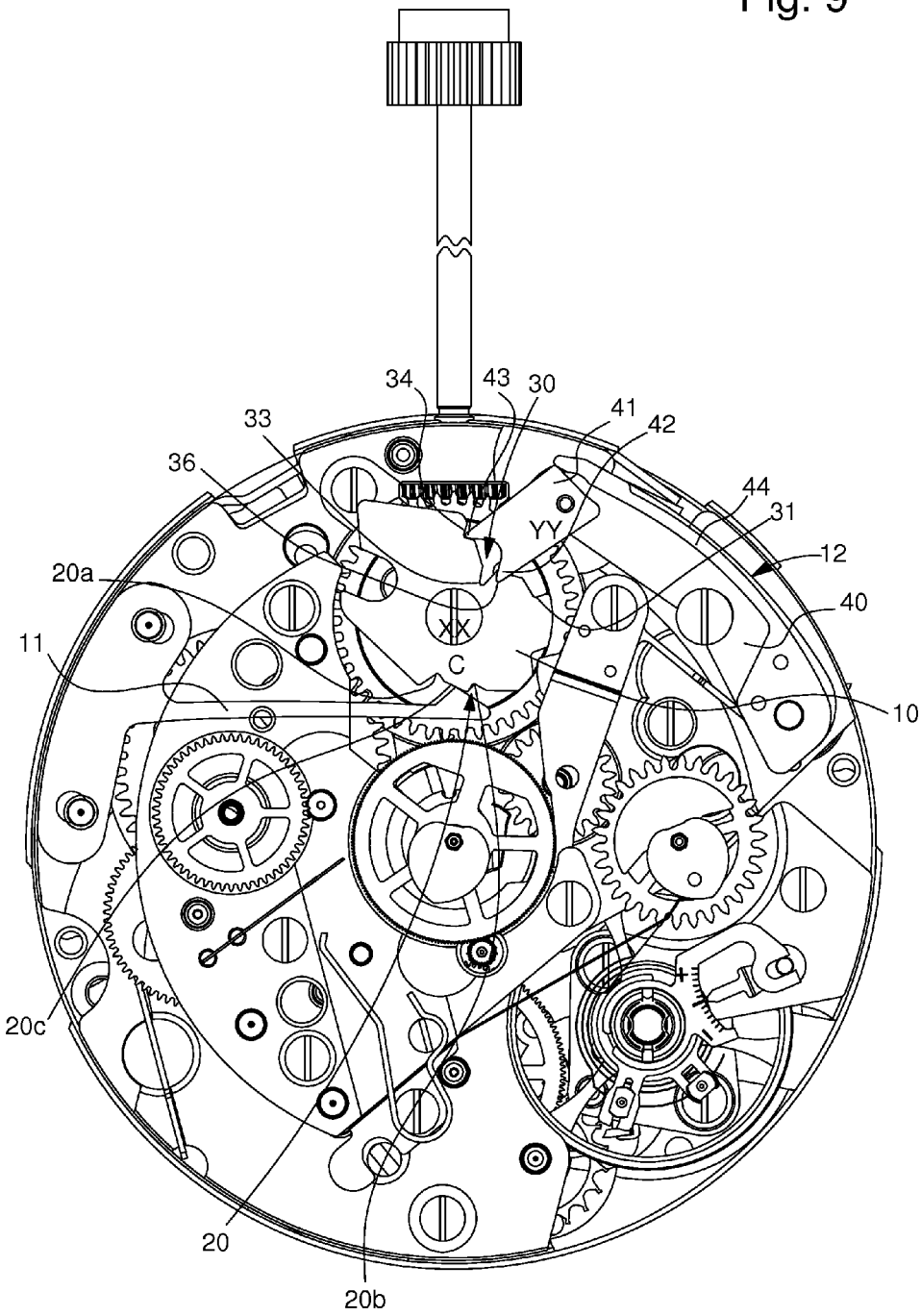

Reference will be made now to FIG. 9 which shows a fourth embodiment of the single push-piece chronograph according to the invention in the "stop" position. In this embodiment, notch 36 replaces recess 32 and stop member 35 is absent. When the user presses push-piece 12 for a second time, second beak 43 pushes the corner of the second L-shaped cut out portion 34, which causes shuttle 10 to pivot anticlockwise. The pivoting of shuttle 10, combined with that of push-piece 12 and finger 41, enables first beak 42 to engage in notch 36. Once it is totally inserted in the notch 36, first beak 42 locks the pivoting movement of shuttle 10, which is then in unstable angular position C corresponding to the chronograph "stop" function. As previously, shuttle 10 remains in unstable position C for as long as the user keeps push-piece 12 pushed in. The operation of this fourth embodiment of the single push-piece chronograph according to the invention is, otherwise, identical to that described with reference to FIGS. 2 to 6.

Thus, as described above, the present invention concerns a chronograph including a chronograph train, means for coupling the train and a device for controlling the coupling means, which incudes: (a) a pivotaby mounted shuffle, a first angular sector of which is provided with two notches defining first and second stable angular positions, and a second angular sector of which includes cut out portions, (b) an elastic member cooperating with the notches to keep the shuttle in one of the stable positions, and (c) a push-piece cooperating with the cut out portions to pivot the shuttle, via a first application of pressure, from the first stable position to the second stable position, and via a second application of pressure, from the second stabe position to a third intermediate angular position. The third intermediate position is unstable and defined on the first angular sector of the shuttle by an inclined surface located between the notches, and the inclined surface is arranged such that the action of the elastic member causes the shuttle to pivot from the third position to the first stabe position when the push-piece is released. The device for controlling the coupling means further includes means for locking the shuttle in the third unstable position when the push-piece is pushed in.

A single push-piece chronograph has thus been described that completes one cycle in two applications of pressure. Of course, the single push-piece chronograph according to the invention is not limited to the embodiment that has just been described and various simple alterations and variants can be devised by those skilled in the art without departing from the scope of the invention defined by the annexed claims.

What is claimed is:

1. A chronograph including a chronograph train, means for coupling said train and a device for controlling the coupling means, which includes:

a shuttle pivotably mounted about an axis, a first angular sector of which is provided with two notches defining first and second stable angular positions, and a second angular sector of which includes cut out portions, an elastic member cooperating with said notches to keep the shuttle in one of said stable positions, and a push-piece cooperating with said cut out portions to pivot the shuttle, as a result of a first application of pressure, from the first stable position to the second stable position, and as a result of a second application of pressure, from the second stable position to a third intermediate angular position, wherein said third intermediate position is unstable and defined on said first angular sector of the shuttle by an inclined surface located between said notches, said inclined surface being arranged such that the action of the elastic member causes the shuttle to pivot from said third position to said first stable position when the push-piece is released, and wherein the device for controlling the coupling means further includes means for locking the shuttle in the third unstable position when the push-piece is pushed in.

2. The chronograph according to claim 1, wherein the push-piece is formed of a pivotably mounted arm, provided with a finger, mounted to rotate freely on said arm about an axis YY, and ending in first and second beaks cooperating with said cut out portions to pivot said shuttle or lock said shuttle in said three angular positions.

3. The chronograph according to claim 2, wherein the locking means includes a stop member mounted in proximity to said finger and a recess, formed in the second angular sector including a second approximately radial flank, said stop member and the recess being arranged such that said radial flank abuts against said first beak when the shuttle is in the third unstable position, the finger then abutting against said stop member.

4. The chronograph according to claim 2, wherein the locking means includes an L-shaped cut out portion arranged such that, when said elastic member acts on said shuttle to pivot said shuttle from the third angular position to the first angular position, said first beak cooperates with said L-shaped blanked portion to counter the action of the elastic member and lock the shuttle in said third angular position.

5. The chronograph according to claim 4, wherein the angle $\alpha$ formed between the pivoting axis of said shuttle, the point of contact P of said first beak with the corner of said L-shaped cut out portion and the axis of rotation of said finger is less than 180 degrees.

6. The chronograph according to claim 2, wherein said arm further includes an elastic member acting on said finger and sized so as to exert on said finger, in the third angular position, a greater moment than the moment exerted by said elastic member via the shuttle.

7. The chronograph according to claim 2, wherein said arm further includes an elastic member acting on said finger and pre-shaped to exert on said finger, in the third angular position a greater moment than the moment exerted by said elastic member, via the shuttle.

8. The chronograph according to claim 2, wherein the locking means includes a notch formed in the second angular sector, in which said first beak is inserted when said shuttle is in the third unstable position and said push-piece is pushed in, said notch being arranged to lock the pivoting of the shuttle, controlled by the action of the elastic member.

* * * * *